US007789233B2

(12) United States Patent
Levy et al.

(10) Patent No.: US 7,789,233 B2
(45) Date of Patent: Sep. 7, 2010

(54) DRUG DELIVERY BOX FOR INDIVIDUAL DOSES OF MEDICINE

(75) Inventors: Gordon Levy, Denver, CO (US); Ken Pepper, Aurora, CO (US); John Chaisson, Aurora, CO (US); Jonathan Curts, Denver, CO (US)

(73) Assignee: Navajo Manufacturing Company, Inc., Denver, CO (US)

( * ) Notice: Subject to any disclaimer, the term of this patent is extended or adjusted under 35 U.S.C. 154(b) by 240 days.

(21) Appl. No.: 11/797,575

(22) Filed: May 4, 2007

(65) Prior Publication Data

US 2008/0272011 A1 Nov. 6, 2008

(51) Int. Cl.
*B65D 51/00* (2006.01)

(52) U.S. Cl. ..... 206/459.5; 206/461; 206/470; 206/806

(58) Field of Classification Search ..... 206/464, 206/461, 467, 470, 471, 806; 229/117.14, 229/117.18
See application file for complete search history.

(56) References Cited

U.S. PATENT DOCUMENTS

| | | | | | |
|---|---|---|---|---|---|
| 2,799,391 | A | * | 7/1957 | Eisner | 206/232 |
| 3,326,361 | A | | 6/1967 | Zimmerman | 206/44 |
| 4,413,730 | A | | 11/1983 | Morse | 206/232 |
| 4,872,555 | A | | 10/1989 | Shadrach, III et al. | 206/459 |
| 4,896,821 | A | * | 1/1990 | Bell | 229/69 |
| 5,038,930 | A | | 8/1991 | Holtkamp, Jr. | 206/232 |
| 5,074,462 | A | | 12/1991 | Countee, Jr. | 229/155 |
| 5,117,973 | A | | 6/1992 | Lo Duca | 206/45.29 |
| 5,232,087 | A | | 8/1993 | Schluger | 206/45.29 |
| 5,293,994 | A | | 3/1994 | Antik | 206/387 |
| 5,377,836 | A | * | 1/1995 | Eisenbraun | 206/461 |
| 5,458,235 | A | | 10/1995 | Stone | 206/232 |
| 5,474,183 | A | | 12/1995 | Warren et al. | 206/459.5 |
| 5,494,153 | A | | 2/1996 | Housman | 206/45.29 |
| 5,497,876 | A | | 3/1996 | Fleming | 206/232 |
| 5,566,831 | A | | 10/1996 | Swenson | 206/767 |
| 5,575,384 | A | | 11/1996 | Saye | 206/232 |
| RE35,445 | E | * | 2/1997 | Pora | 206/459.5 |
| 5,779,048 | A | | 7/1998 | Dunn | 206/449 |
| 5,819,939 | A | | 10/1998 | Boyer | 206/461 |
| 5,899,333 | A | * | 5/1999 | Williams et al. | 206/469 |
| 5,971,261 | A | | 10/1999 | Grünfeld et al. | 229/102 |
| 6,053,325 | A | | 4/2000 | Yonker et al. | 206/736 |
| 6,155,414 | A | * | 12/2000 | Vaessen | 206/469 |
| 6,209,292 | B1 | | 4/2001 | Krahn | 53/458 |
| 6,666,332 | B1 | | 12/2003 | DeWolf et al. | 206/459.5 |
| 6,691,870 | B1 | * | 2/2004 | Palm et al. | 206/462 |
| 7,506,761 | B2 | * | 3/2009 | Levy | 206/459.5 |
| 2007/0199850 | A1 | * | 8/2007 | Levy | 206/464 |

* cited by examiner

*Primary Examiner*—Ehud Gartenberg
*Assistant Examiner*—Andrew Perreault
(74) *Attorney, Agent, or Firm*—Jacobson Holman PLLC

(57) ABSTRACT

A four-ply paper board hanging hole in a display box for hanging a display box from a support rod. This is accomplished by the use of a paper board die blank having a hanging hole in four layers of the box such that, when the box is assembled, the four hanging holes are aligned to provide a strongly reinforced hanging hole which proves quite difficult to rip. Therefore, an increased aesthetic appearance of the display box is achieved, resulting in increased sales and minimal wasting of display box products.

1 Claim, 10 Drawing Sheets

44

46

DRUG DELIVERY BOX FOR INDIVIDUAL DOSES OF MEDICINE

FIELD OF THE INVENTION

The present invention relates to the field of retail drug sales boxes containing a plurality of individual doses of medicine, such as over the counter medicines.

BACKGROUND OF THE INVENTION

In drug stores, convenience stores, grocery stores or other retailers selling small quantities of non-prescription drugs, a display device is usually used to display one or two packets of a pain reliever, for example. Small quantities of other medicines or bandages, may be displayed by the display device.

However, when displaying a box of a non-prescription medicine, for example, the box is usually hung from a rod or peg extending from a display board, such as a peg board, at the retail location. A consumer will customarily remove the box from the display device to review the information contained on the box of medicine prior to its purchase.

The repeated removal and re-hanging of a display box can prove to be detrimental to the hanging tab extending from the display box. Therefore, the usually single sheet of paper board, including the hanging portion for the display box, is often times ripped by repeated consumer review. Attempts to fix the broken hanging tab with tape or staples may be functionally acceptable but aesthetically displeasing to the consumer.

Accordingly, there is a need to reinforce display packages hanging on a support rod.

SUMMARY OF THE INVENTION

It is an object of the present invention to overcome the deficiencies of prior practices by the incorporation of a four-ply paper board hanging hole in a display box for hanging a display box from a support rod. This is accomplished by the use of a paper board die blank having a hanging hole in four layers of the box such that, when the box is assembled, the four hanging holes are aligned to provide a strongly reinforced hanging hole which proves quite difficult to rip. Therefore, an increased aesthetic appearance of the display box is achieved, resulting in increased sales and minimal wasting of display box products.

This object is also achieved by a display box formed of a single sheet of paper board die cut into a series of interconnected panels with fold lines. The box includes a front panel with a top portion and a vertical extension portion and a rear panel interconnected to the front panel by side panels. The vertical extension portion of the front panel interconnects the front panel and the rear panel at least for a portion of the front panel. Both the front panel and the rear panel include parts of a bottom panel with the front panel including an upper support portion of the bottom panel and the rear panel including a lower portion of the bottom panel. The lower portion of the bottom panel includes adhesive for securing to the upper support portion of the bottom panel.

Secured along the intersection of a side panel and the rear panel is a drug facts panel. The drug facts panel is pivotally mounted along the intersection of the side panel and the rear panel and includes a front panel portion and a rear panel portion. The front panel portion and the rear panel portion are adhered to each other and each include a hanging hole. In addition, the rear panel and the front panel include a hanging hole so that, when the display box is assembled, there are four layers of paper board forming a single aligned hanging hole.

In addition, the rear panel includes a die cut flap providing access to the interior of the box cavity. The perforations forming the access flap are cut from the rear panel to pivotally mount the access flap along a side edge of the box formed at the intersection of the rear panel and the opposite side panel from the side panel to which the drugs facts panel is pivotally mounted. The access flap includes a finger slot which is used to reach into the box cavity and pull the access flap out from the rear panel, pivoted about the side edge of the box, to gain access to the interior of the box.

After product is removed from the interior of the box, the access flap is folded down to lay flat in alignment with the rear panel. The drugs facts panel is then closed on top of the rear panel and by the use of glue dots, the rear panel is secured to the drugs facts panel.

By the movement of the access flap, and the return of the access flap into alignment with the rear panel, all drug information/packaging graphics of the rear panel remain intact. The information desired to be conveyed to the consumer is still readily available. This is in contrast to prior designs of packaging where to gain access to the interior of the packaging, the integrity of the packaging is destroyed and the valuable consumer information displayed on the exterior of the packaging is damaged. The consumer can therefore no longer take advantage of the information and potential warnings contained on the packaging for ready reference. The packaging may also be discarded by the consumer because the packaging cannot easily be re-sealed.

Accordingly, it is an object of the present invention to provide a drug delivery box having four layers of paper board at the hanging hole.

It is another object of the present invention to provide a drug dispensing box having four layers of paper board at the hanging hole and having a drugs facts panel pivotally mounted to a rear edge of the box.

It is still yet another object of the present invention to provide a drug dispensing box having four layers of paper board at the hanging hole and having a drugs facts panel pivotally mounted to a rear edge of the box and having an access flap in a rear panel of the box for gaining access to an interior of the box.

It is still yet another object of the present invention to provide a drug dispensing box having four layers of paper board at the hanging hole and having a drugs facts panel pivotally mounted to a rear edge of the box and having an access flap in a rear panel of the box for gaining access to an interior of the box, the access panel being pivotally mounted to a rear edge of the box for return to alignment with the rear panel of the box and sealing by the drug facts panel.

These and other objects of the invention, as well as many of the intended advantages thereof, will become more readily apparent when reference is made to the following description taken in conjunction with the accompanying drawings.

BRIEF DESCRIPTION OF THE DRAWINGS

The following drawings illustrate examples of various components of the drug display box disclosed herein, and are for illustrative purposes only. Other embodiments that are substantially similar can use other components that have a different appearance.

DETAILED DESCRIPTION OF THE PREFERRED EMBODIMENTS

Figure 1:
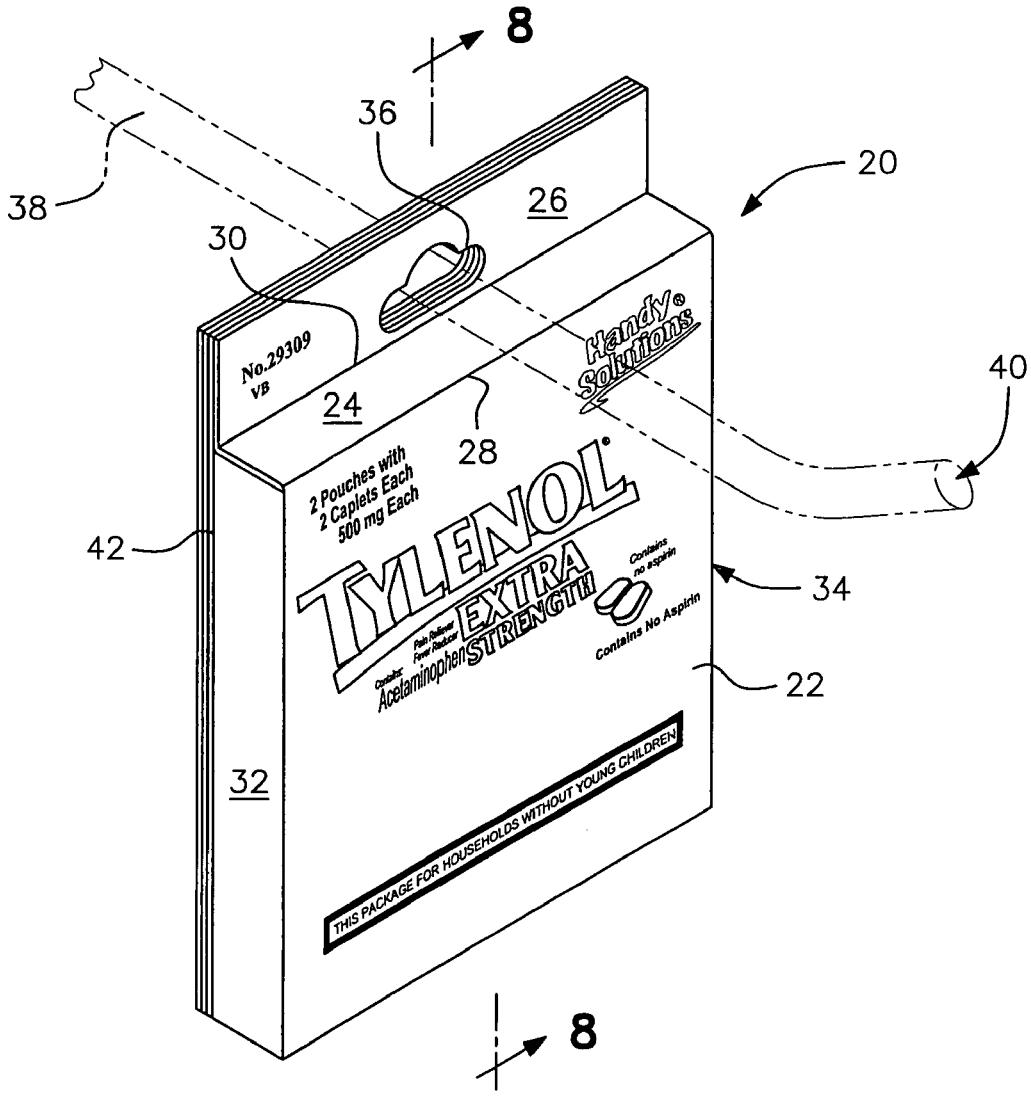
FIG. 1 is a perspective view of the drug delivery/display box of the present invention hanging from a peg at a retail location.
Figure 2:
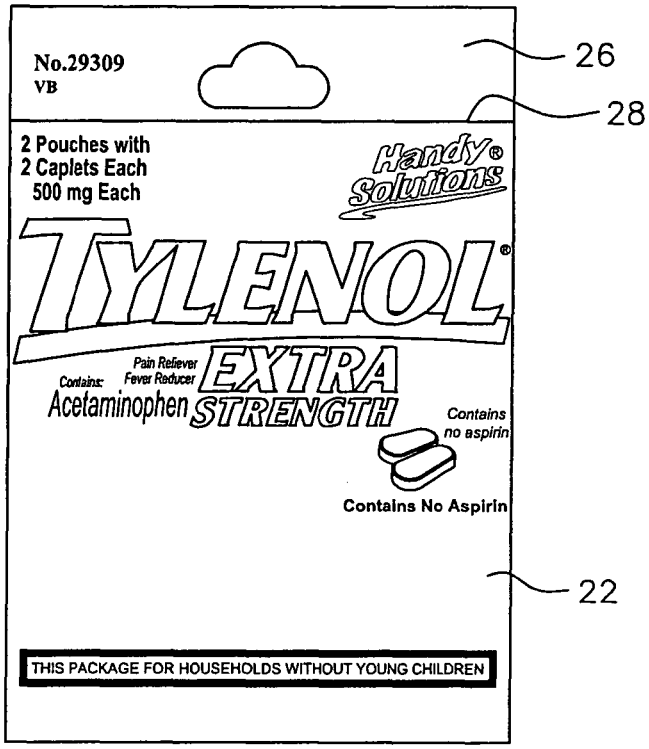
FIG. 2 is a front view of the drug delivery/display box.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and FIGS. 1-8, in particular, a drug delivery/display box embodying the teachings of the subject invention is generally designated as 20. With reference to its orientation in FIG. 1, the drug display box includes a front panel 22 including a top portion 24 and upstanding portion 26. The top portion 24 extends rearwardly from front edge/fold line 28 and to rear edge/fold line 30. Upstanding portion 26 is folded at a right angle at edge 30 with respect to top portion 24. The top portion 24 extends laterally between right side panel 32 and left side panel 34.

Upstanding portion 26 includes a hanging hole 36. The particular shape of hanging hole 36 may be altered to include a triangular shape or any other shape used for hanging a drug display box from a rod 38 by passing a leading end 40 of the rod through the hole 36.

With reference to FIG. 1, a rear panel 42, extending the combined height of the front panel 22 and upstanding portion 26, extends in a plane parallel to the front panel 22 and upstanding portion 26 and engages the upstanding portion 26. The rear panel 42 is spaced from the front panel 22 by a distance equal to the extension of top portion 24 between fold lines 28 and 30.

Figure 3:
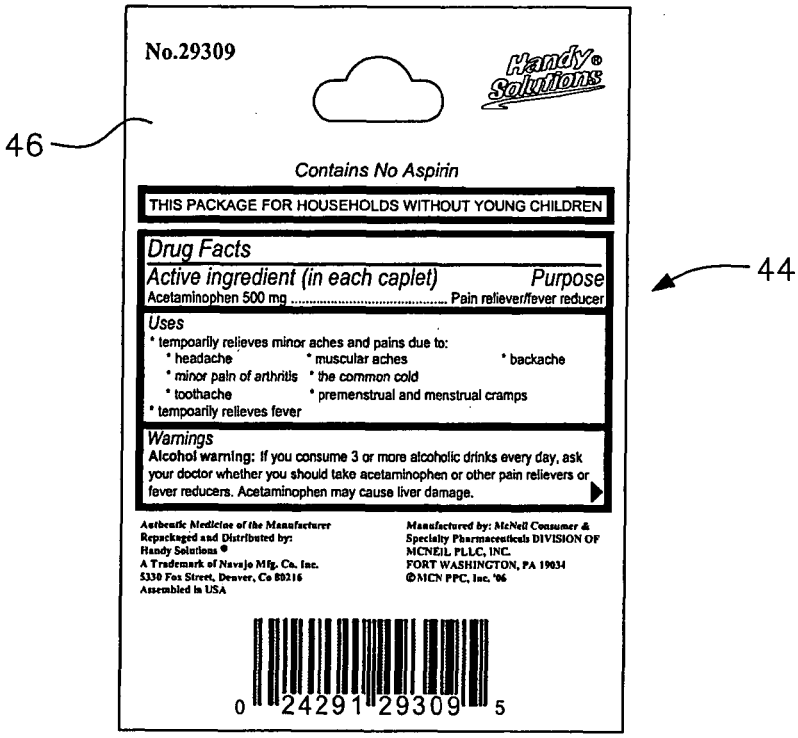
FIG. 3 is a rear view of the drug delivery/display box.
Figure 4:
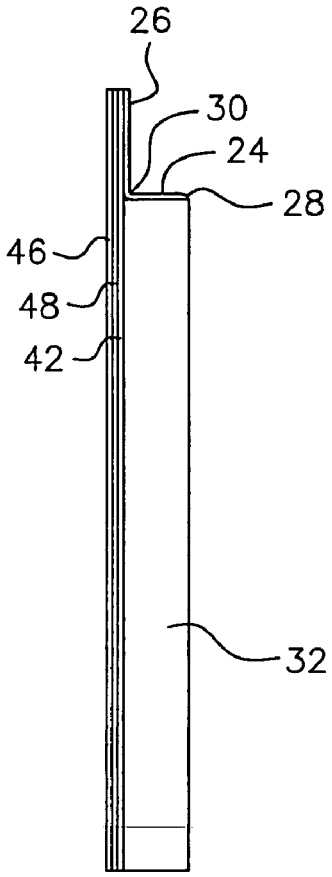
FIG. 4 is a left side view of the drug delivery/display box.
Figure 5:
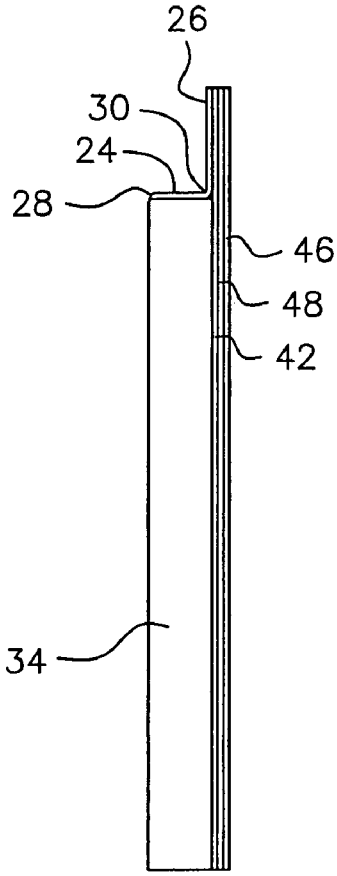
FIG. 5 is a right side view of the drug delivery/display box.
Figure 6:
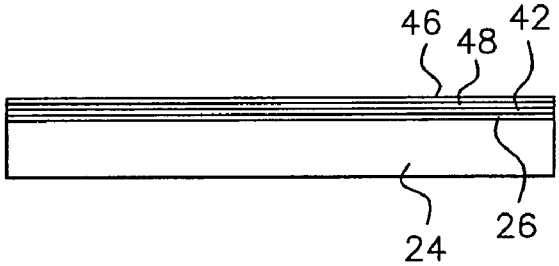
FIG. 6 is a top view of the drug delivery/display box.
Figure 7:
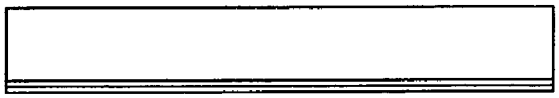
FIG. 7 is a bottom view of the drug delivery/display box.
Figure 8:
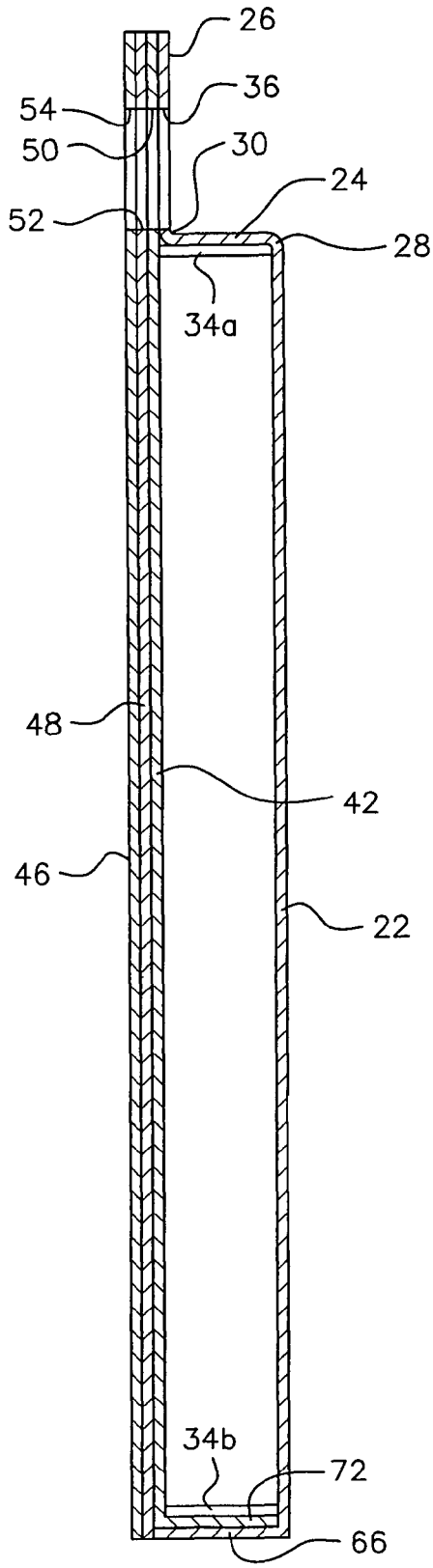
FIG. 8 is a cross-sectional view taken along line 8-8 of FIG. 1.

Extending parallel to rear panel 42 is a drug facts panel 44 including a rear panel portion 46 as shown in FIG. 3. As shown in FIGS. 4, 5 and 8, a front panel portion 48 is glued to rear panel portion 46 to form the drug facts panel 44 pivotally mounted to a side edge of the drug display box.

As shown in FIG. 8, the hanging hole 36 of upstanding portion 26 is in alignment with the hanging hole 50 of rear panel 42 and the hanging hole of drug facts panel 44 including the hanging hole 52 of front panel portion 48 and the hanging hole 54 of rear panel portion 46. The four aligned hanging holes provide greatly increased strength for supporting the drug display box of the present invention for numerous incidents of removal and re-replacing of the drug display box on a support rod 38.

Figure 9:
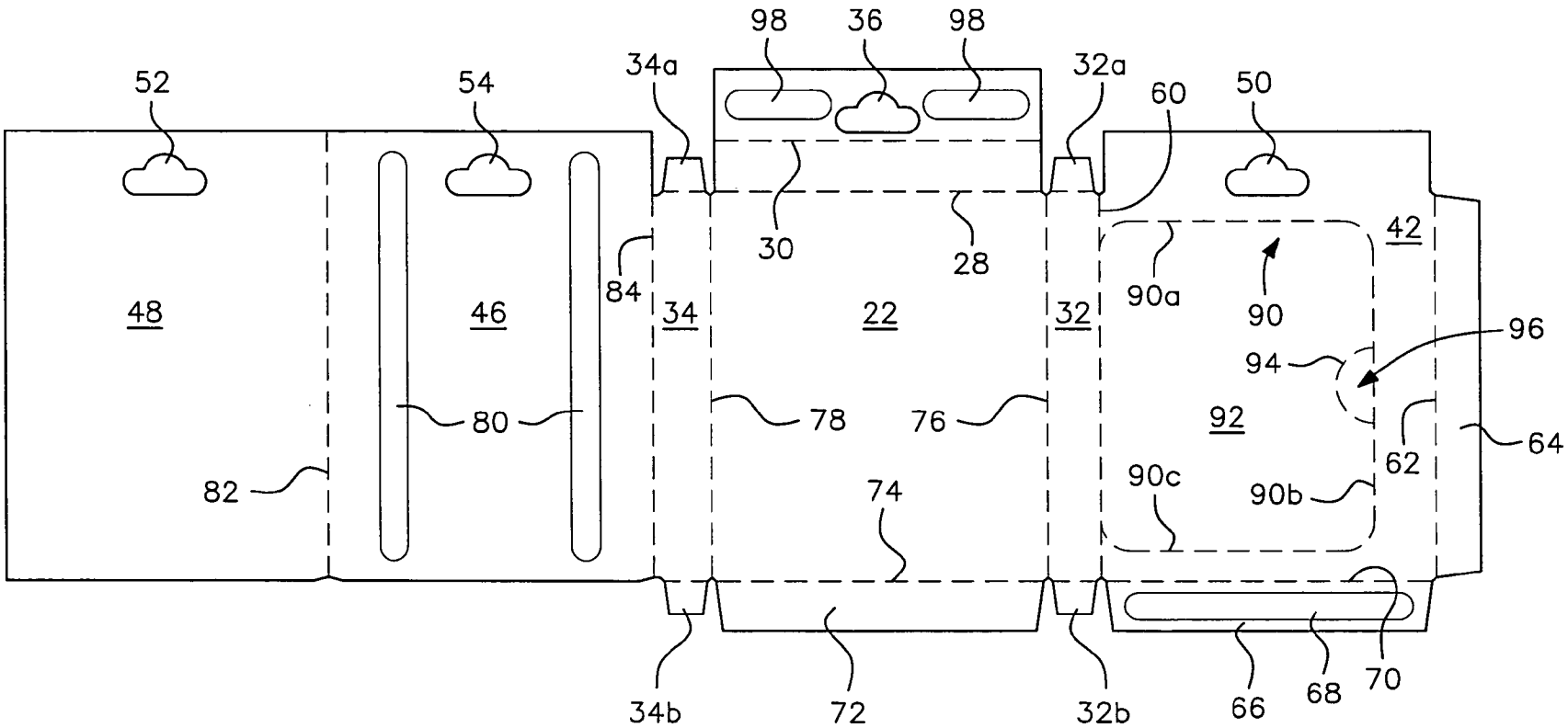
FIG. 9 schematically illustrates the die lines of the interior of the drug display box of the present invention formed of a single sheet of paper board.
Figure 10:
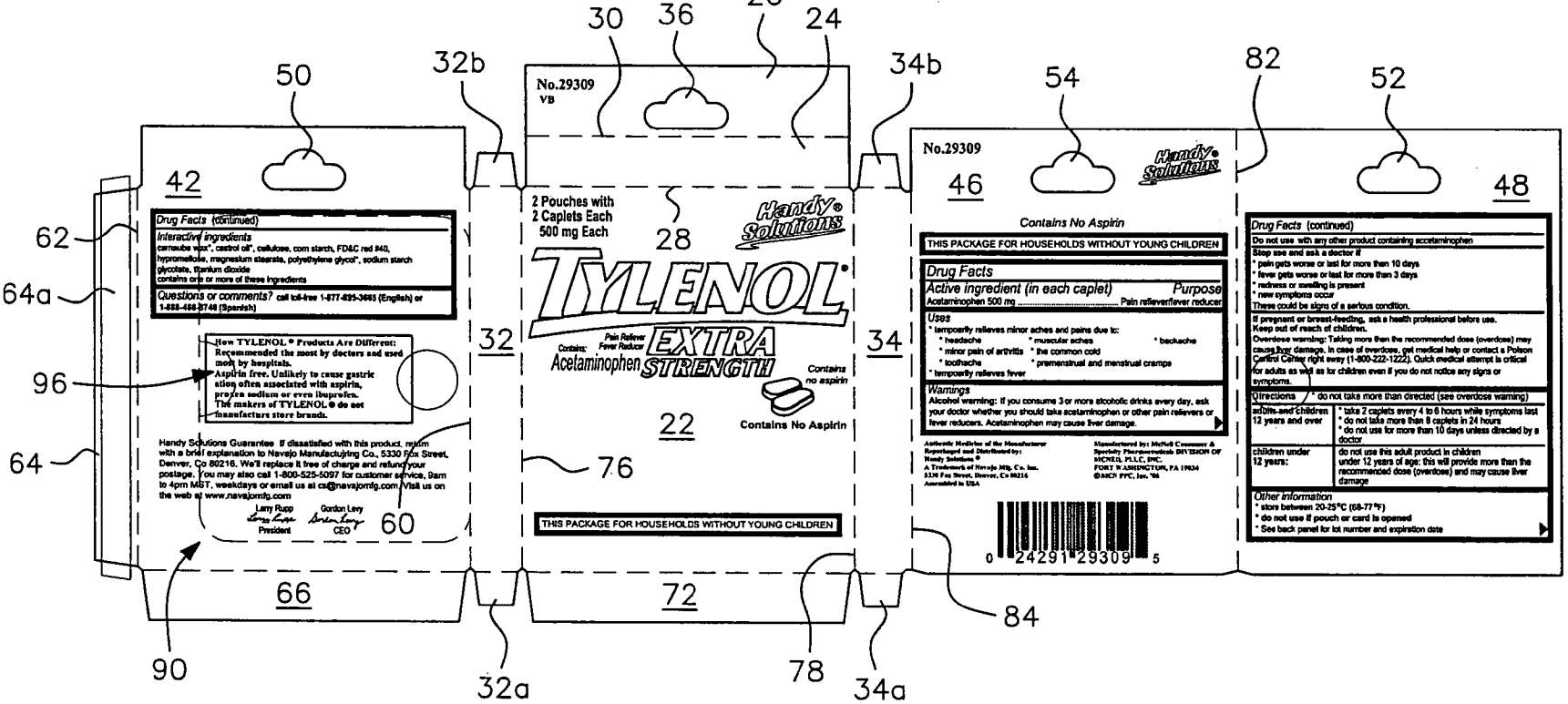
FIG. 10 is an exterior view of the die lines of the drug display box.

As shown in greater detail in FIGS. 9 and 10, the layout of a single piece of paper board is shown which is used to form the drug display box of the present invention. In FIG. 9, the rear panel 42 is shown connected to side panel 32 by fold line 60. At an opposite edge, fold line 62 connects to side support panel 64. The opposite side of side support panel 64, as shown in FIG. 10, includes an adhesive surface 64*a* covered by a piece of removable tape for forming the display box.

Located between side panel 32 and side support panel 64 is bottom panel 66 having adhesive layer 68. Bottom panel 66 is separated from rear panel 42 by fold line 70.

Front panel 22, in addition to top portion 24 and upstanding portion 26, includes a bottom support panel 72 connected to front panel 22 by fold line 74. The bottom support panel 72 will sit on top of bottom panel 66, as shown in FIG. 8, to reinforce the bottom of the display box.

The side panel 32 is connected to front panel 22 by fold line 76, whereas side panel 34 is connected to front panel 22 by fold line 78. Both of the side panels 32 and 34 include fold flaps 32*a*, 32*b* and 34*a*, 34*b*, respectively.

The drugs facts panel 44 is formed by folding front panel portion 48 along fold line 82 onto rear panel portion 46 such that the glue strip areas 80 are engaged by front panel portion 48 to secure the front panel portion 48 to rear panel portion 46 and align the hanging holes 52 and 54. The rear panel portion 46 is pivotally connected to the side panel 34 by fold line and edge 84.

As shown in FIGS. 9 and 10, the rear panel 42 includes a perforation line 90 having sections 90*a*, 90*b* and 90*c*. The perforation line 90 forms access flap 92 pivotally mounted along fold line 60 to side panel 32. A finger hole perforation line 94 is cut to gain access to the interior of the box when the finger hole tab 96 is removed by breaking the perforation line 94.

With reference to FIG. 10, the printing of the required drug use information and all other indicia is achieved by a single sided printing. This reduces the cost of production and increases the efficiency of production.

The display box of the present invention is formed by folding front panel portion 48 onto rear panel portion 46 and securing the two panel portions together to form the drug facts panel. The two side panels 32, 34 are then folded perpendicular to the front panel 22 along fold lines 76,78, respectively. The flaps 32*a*, 32*b* and 34*a*, 34*b* are folded inwardly to form support surfaces.

The rear panel 42 is then folded along fold line 60 to lie parallel to front panel 22 by a separation distance equal to the width of side panels 32 or 34. The adhesive 64*a* on side support panel 64 is then brought into engagement, after folding along fold line 62, with the underside of side panel 34. A rectangular-shaped box is thereby formed.

Bottom support panel 72 is folded along fold line 74 and thereafter bottom panel 66 is folded to engage its adhesive surface 68 with the bottom support panel 72 to form the bottom of the box. Finally, the top portion 24 is folded along fold line 28 to extend parallel to the bottom panel 66 and the upstanding portion 26 is folded along fold line 30 to extend parallel to the rear panel 42 and adhere the upstanding portion 26 by glue strips 98 to the rear panel 42. The four hanging holes 36, 50, 52 and 54 are aligned in successive order to form a four layer supportive hanging hole.

Figure 11:
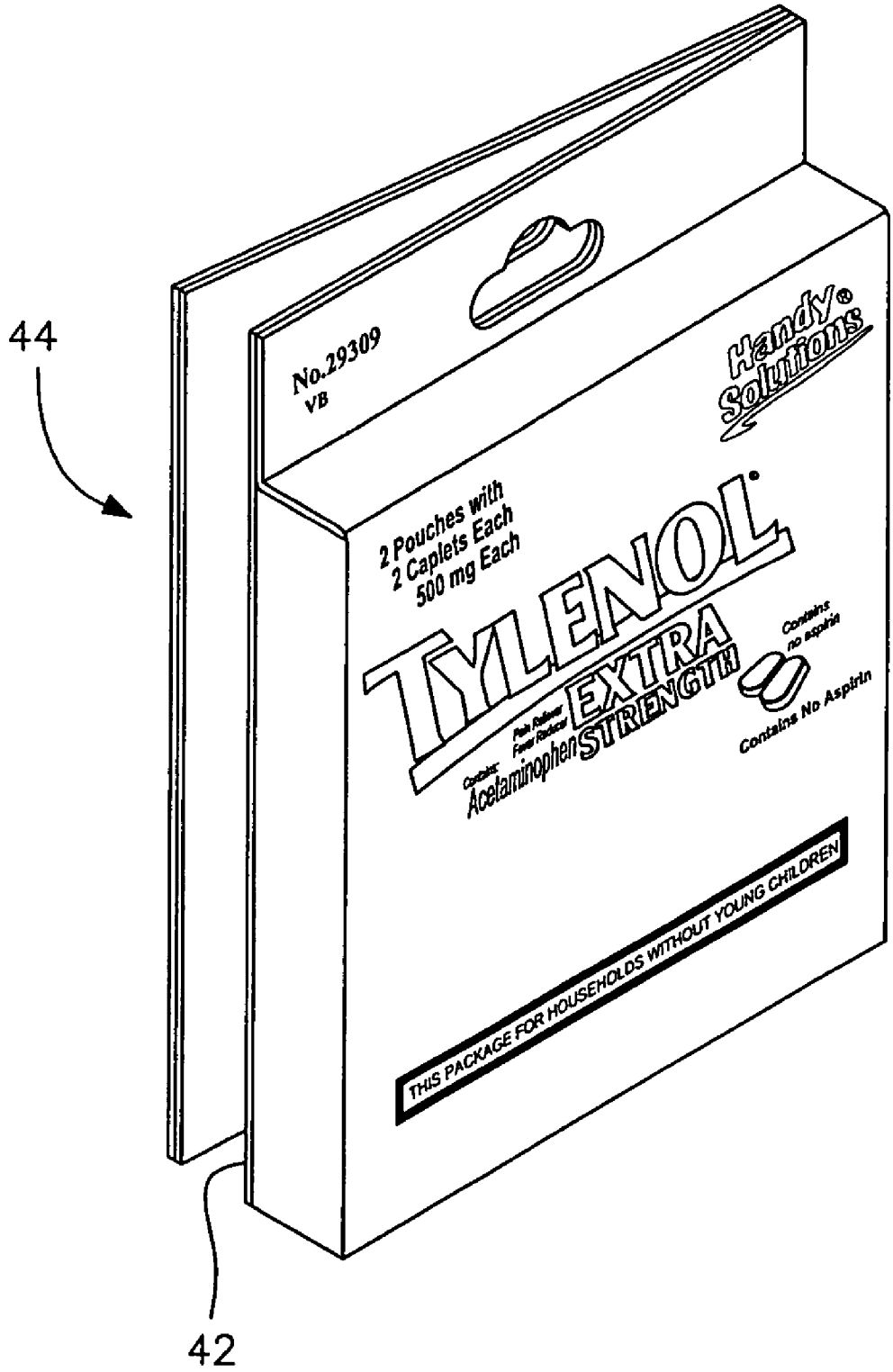
FIG. 11 is a perspective view illustrating the drug facts panel pivotally mounted to a rear panel of the drug display box.
Figure 12:
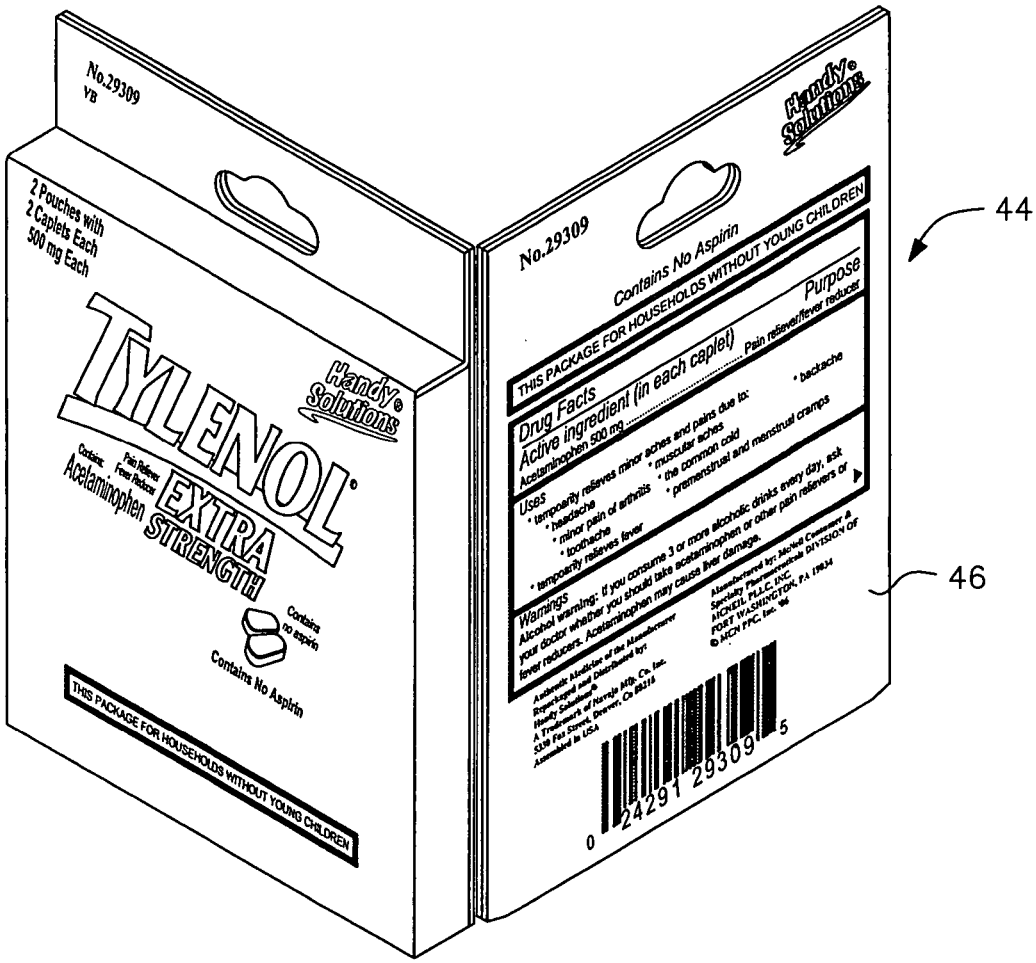
FIG. 12 is a perspective view illustrating the fully opened position of the pivoted drug facts panel pivotally mounted on the rear panel.

With reference to FIG. 11, the drug facts card 44 is shown pivoted away from the rear panel 42. In this position, and the position shown in FIGS. 12 and 13, viewing of the indicia written on the rear panel portion 46, the front panel portion 48 and the rear panel 42 is possible. This indicia provides important information on the use and directions for use of the medication included in the display box.

Figure 13:
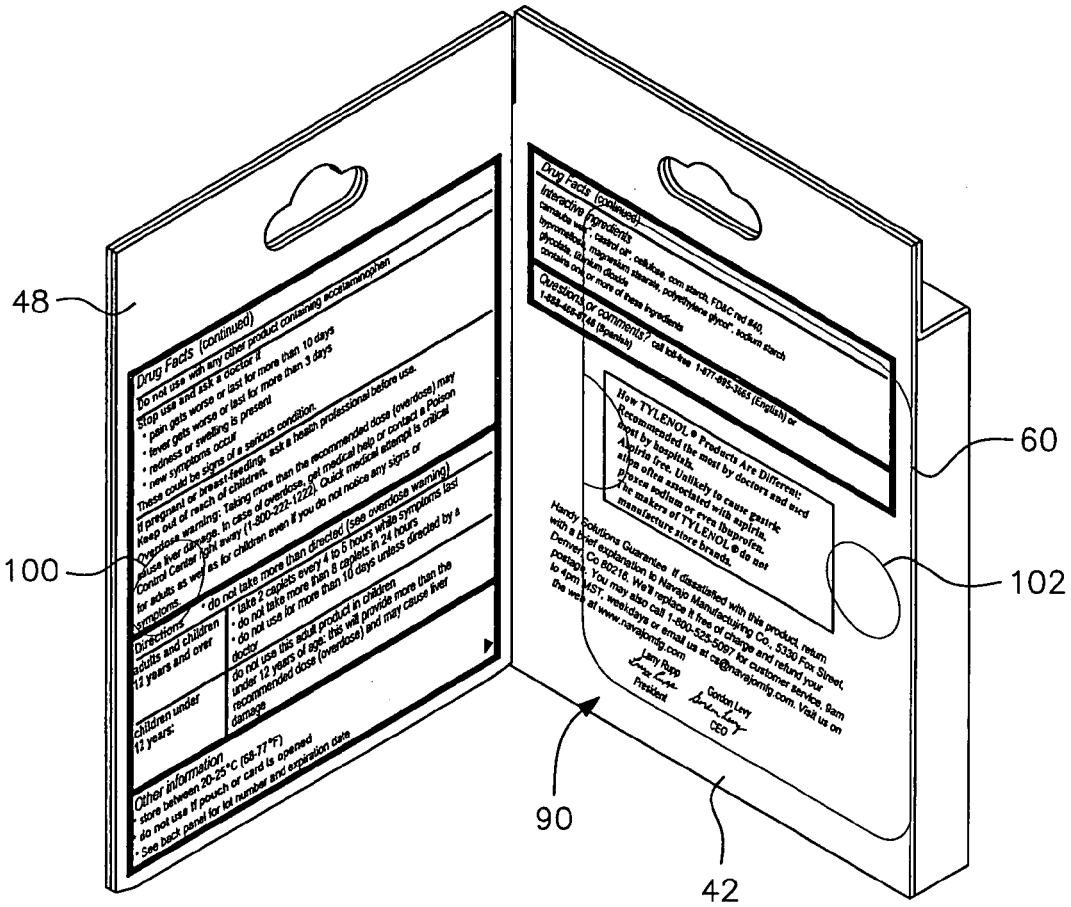
FIG. 13 is a rear perspective view of the drug facts panel pivotally mounted on the drug display box and exposing the access flap pivotally mounted from a rear edge of the rear panel.

As shown in FIG. 13, the front panel portion 48 includes a glue dot 100, as shown by a circle, with a corresponding complimentary located glue dot 102 located on the rear panel 42. The front panel portion 48 and the rear panel 42 are thereby releasably secured or interconnected to prevent inadvertently moving the front panel portion 48 away from the rear panel. When moving the front panel portion 48 into engagement with the rear panel 42, the alignment of the front panel portion 48 and the rear panel 42 in parallel overlying orientation is maintained.

Figure 14:
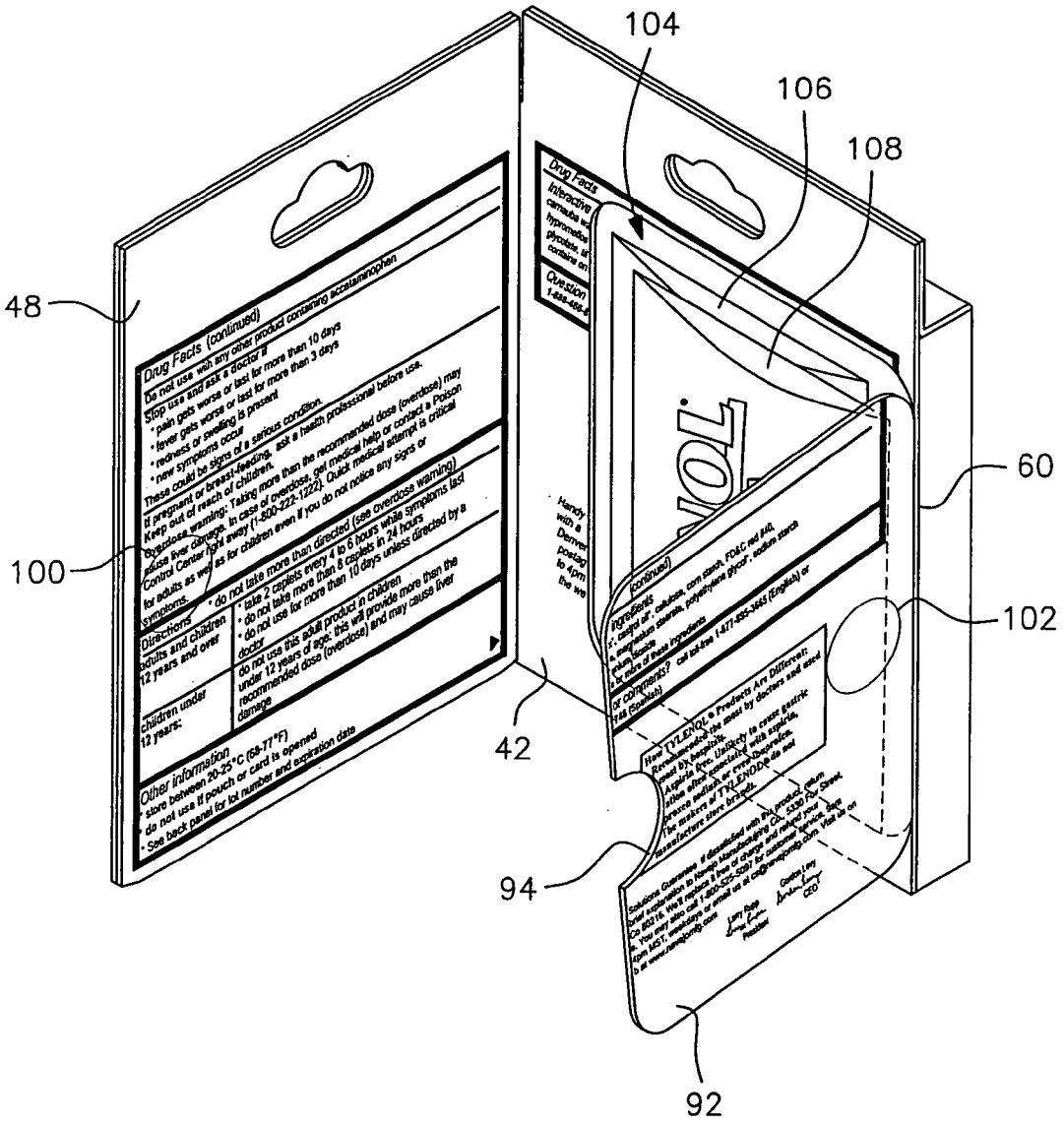
FIG. 14 illustrates the pivoting of the access flap to gain access to at least one of a plurality of packages of medicine with the access flap being movable into the plane of the rear panel and being covered by the drug facts panel.

As explained with reference to FIG. 9, perforation line 90 is accessible when the front panel portion 48 is moved away from the rear panel 42. As shown in FIG. 14, after removal of the finger hole tab 96 along perforation 94, it is possible to pivot the access flap 92 about fold line 60 to provide access to the interior 104 of the box.

Housed within the box may, for example, be located two single dose medicine packages 106 and 108. Access is provided to the medicine packages by pivoting of the access flap 92. One of the medicine packages may be removed from the interior 104 of the box and the access flap 92 returned to an orientation in the plane of rear panel 42. Thereafter, the front panel portion 48 may be moved to overlie the rear panel 42, thereby securing the closure of the access flap 92, preventing access to the interior 104 of the box.

With the access flap 92 returned to the plane of the rear panel 42, substantial portions of the indicia would still be in a readable format. The integrity of the packaging being maintained, repeated use of the packaging by the consumer is available for subsequent use of any additional stored medicine contained in the interior 104 of the package.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. A drug storage box for housing a plurality of doses of over the counter medicine, said drug storage box comprising a single sheet of die cut paper board having a series of interconnected planar panels with fold lines between all of the interconnected planar panels, the single sheet of die cut paper board being printed on only one side, and folded and adhered to form a hollow storage container including a front panel, a rear panel, two side panels, a bottom panel and a top panel, the front panel and the rear panel having an equal width and the two side panels, the bottom panel and the top panel having an equal width, a drug facts panel pivotally mounted with respect to the rear panel at one of the two side panels on the storage container and the drug facts panel being releasably secured to the rear panel for repeatedly releasing and reattaching the drug facts panel to the rear panel, the drug facts panel including a front panel portion and a rear panel portion interconnected by a fold line, the front panel portion being secured to the rear panel portion, and a hanging hole formed in alignment by four layers of paper board material for hanging the storage container from a display device, the four layers being the front panel, the rear panel, the front panel portion of the drug facts panel and the rear panel portion of the drug facts panel, a plurality of individually sealed medicine packages contained in the storage container, the rear panel of the storage container including an access flap providing access to an interior of the storage container and access to the plurality of individually sealed medicine packages, the access flap being pivotally mounted on the storage container, the drug facts panel being pivotally mounted with respect to the rear panel and completely overlying the rear panel, the access flap being removable from the rear panel by a perforation line forming three of four sides of the access flap, a fourth side of the access flap being located on the rear panel at the other of the two side panels at a fold line interconnecting the rear panel and the other of the two side panels of the storage container for allowing the pivotal mounting of the access flap on the storage container.

* * * * *